United States Patent [19]

Ikeda et al.

[11] Patent Number: 4,643,602

[45] Date of Patent: Feb. 17, 1987

[54] CARRIAGE SUPPORTING DEVICE FOR A PRINTER

[75] Inventors: Hiroshi Ikeda; Tsutomu Iesaka, both of Tanashi, Japan

[73] Assignee: Citizen Watch Co., Ltd., Tokyo, Japan

[21] Appl. No.: 711,363

[22] Filed: Mar. 13, 1985

[30] Foreign Application Priority Data

Mar. 14, 1984 [JP] Japan ..... 59-36396[U]

[51] Int. Cl.[4] ..... B41J 11/22

[52] U.S. Cl. ..... 400/354; 400/320

[58] Field of Search ..... 400/320, 352, 353, 354

[56] References Cited

U.S. PATENT DOCUMENTS

| | | | |
|---|---|---|---|
| 4,279,518 | 7/1981 | Blomquist | 400/354 X |
| 4,303,347 | 12/1981 | Siegenthaler | 400/354 |
| 4,468,144 | 8/1984 | McMahon | 400/354 |
| 4,514,100 | 4/1985 | Laspesa | 400/353 X |
| 4,526,486 | 7/1985 | Kikuchi | 400/320 X |

*Primary Examiner*—Paul T. Sewell

*Attorney, Agent, or Firm*—Birch, Stewart, Kolasch & Birch

[57] ABSTRACT

A carriage supporting device has a base plate and a guide bar. A guide portion is formed at a rear portion of the base plate. The guide portion has an L-shaped section comprising an upright portion and a guide rail projecting outwardly. A carriage is slidably mounted on the guide bar and on the guide rail through a guide chip made of plastics. The guide chip has an engaging groove slidably engaged with the guide rail.

2 Claims, 3 Drawing Figures

CARRIAGE SUPPORTING DEVICE FOR A PRINTER

BACKGROUND OF THE INVENTION

The present invention relates to a device for supporting a carriage for a printer, such as a dot matrix printer as an output device of a computer system, in which the carriage is reciprocated so that a print head mounted thereon moves along a platen for performing the printing operation.

FIG. 1 shows a conventional device for supporting a carriage in a printer. The carriage device comprises a base plate 6 of a frame 6*b*, a carriage guide bar 2 supported on the frame 6*b* and disposed in parallel with a platen 1 rotatably supported on the frame. A carriage 3 having a print head 5 mounted thereon is slidably mounted on the guide bar 2 at the front end portion thereof. The base plate 6 has an upright portion 6*a* to which a guide plate 7 is secured by screws 8, an end of the guide plate 7 being projected from the upright portion 6*a* towards the carriage 3. A pair of rollers 9 and 10 are provided on a bending portion 3*a* formed on the rear end of the carriage 3, engaging with the projected end of the guide plate 7 at both sides thereof, so that the carriage is supported so as to move along the guide bar 2 and guide plate 7.

However, in such a carriage supporting mechanism, the structure is complicated and the carriage has a complicated shape, which results in increase of parts and of the step of assembling process. Further, the flexual rigidity of the base plate 6 is insufficient.

SUMMARY OF THE INVENTION

The object of the present invention is to provide a carriage supporting device for a printer which is simple in structure and may improve the flexual rigidity of a base plate in the device.

According to the present invention, there is provided a carriage supporting device for a printer comprising: a base plate, a guide bar supportedon a frame, a guide portion formed at a rear portion of the base plate, the guide portion having an L-shaped section comprising an upright portion and a guide rail projecting outwardly, a carriage slidably mounted on the guide bar, a guide chip engaged with a connecting portion formed at a rear portion of the carriage, the guide chip having an engaging groove slidably engaged with the guide rail.

In an aspect of the present invention, the base plate is made of metal plate and the guide portion is formed by bending a rear portion of the base plate, and the guide chip is made of plastics. The guide chip has a J-shaped section to form the engaging groove and has a hole engaged with the connecting portion of the carriage.

These and other objects and features of the present invention will become more apparent from the following description with reference to the accompanying drawings.

DESCRIPTION OF THE PREFERRED EMBODIMENTS

Figure 1:
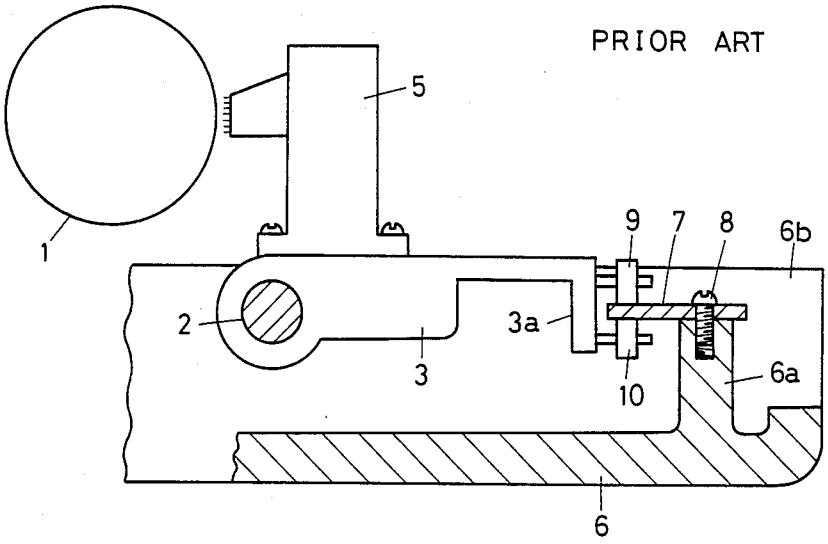
FIG. 1 is a side view showing a conventional carriage supporting device, a part of which is shown in section.
Figure 2:
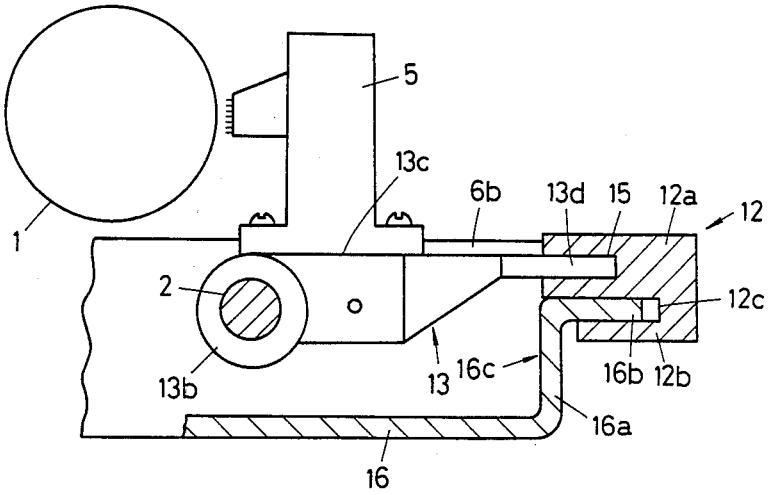
FIG. 2 is a side view of a carriage supporting device for a printer according to the present invention, a part of which is shown in section.
Figure 3:
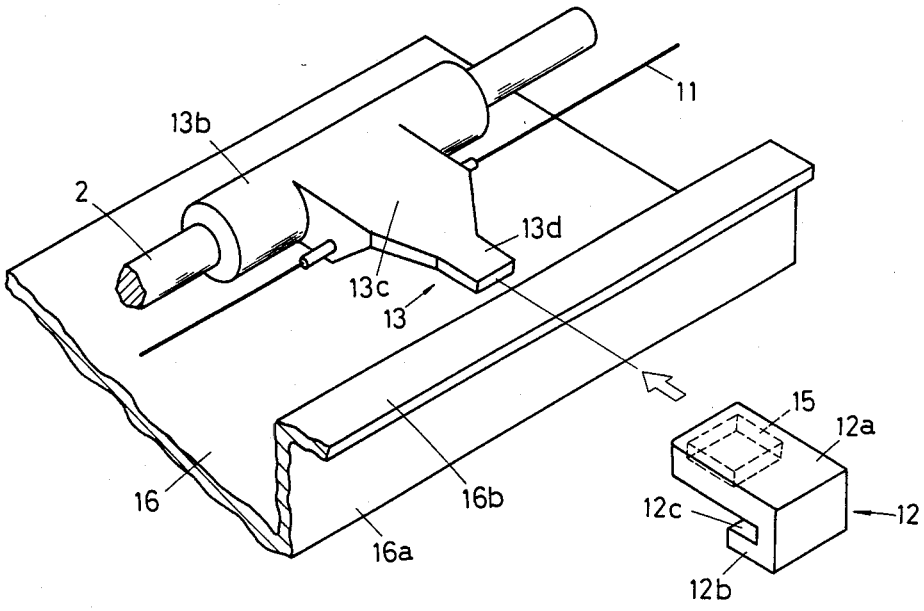
FIG. 3 is an exploded perspective view of the carriage supporting device of the present invention.

Referring to FIGS. 2 and 3, a carriage supporting device of the present invention is provided with the carriage guide bar 2 supported on the frame 6*b* and disposed in parallel with the platen 1 as hereinbefore described about the prior art as shown in FIG. 1. A base plate 16 of the present invention is made of metal plate and bent at a rear portion to form a guide portion 16*c*. The guide portion 16*c* comprises an upright portion 16*a* at the rear end portion and a guide rail 16*b* formed by bending an upper portion of the upright portion 16*a* to be outwardly and horizontally projected. Thus, base plate 16 has the guide portion 16*c* having an L-shaped section. A carriage 13 has a cylindrical portion 13*b* oriented in the axial direction of the guide bar 2 to be engaged with it, a body portion 13*c* extending from a central portion of the cylindrical portion 13*b* for mounting the print head 5, and a connecting portion 13*d* horizontally extended from the rear portion of the body portion 13*c*. A driving cable 11 is connected to both sides of the body portion 13*c* at both ends thereof, which is wound on a driving drum (not shown) for moving the carriage 13 along the platen 1. Engaged with the connecting portion 13*d* and with the guide rail 16*b* is a guide chip 12 made of plastics. The guide chip 12 has a J-shaped section comprising an upper horizontal portion 12*a* and a lower horizonal portion 12*b* and a connecting portion 15 in the form of a hole, formed in the upper horizontal portion 12*a*, having a rectangular cross section. Between the upper and lower portions 12*a* and 12*b*, an engaging groove 12*c* is formed the surface of which is made slippery.

As shown by an arrow in FIG. 3, the connecting portion 13*d* is inserted into the connecting portion 15 and engaged with the guide chip 12, and the guide portion 16*b* is inserted into the groove 12*c*. The guide rail 16*b* is slidably engaged with the surface of the groove 12*c*. Accordingly, the upper portion 12*a* of the guide chip 12 is integrally engaged with the connecting portion 13*d* of the carriage 13, while the upper and lower horizontal portions 12*a*, 12*b* are slidably engaged with the guide portion 16*b* of the base plate 16.

Thus, the carriage 13 is supported on the guide rail 16*b* by the engagement of the guide chip 12 with the connecting portion 13*d* and with the guide rail 16*b* of the base plate 16 at opposite side to the guide bar 2. In such a state, the carriage 13 is moved on the guide bar 2 and reciprocated along the platen 1 for performing the printing operation by the print head 5.

In accordance with the present invention, since a carriage supporting mechanism comprises guide rail 16*b* formed by bending base plate 16 and guide chip 12 engaged with the guide rail 16*b*, the structure is simplified and the number of parts are reduced. Further, the guide chip 12 can be easily assembled by engaging with the connecting portion 13*d* and the guide rail 16*b*. Moreover, the flexual rigidity of the base plate 16 is improved by the construction of an L-shaped section at the guide portion. Since the guide rail 16*b* is bent so as to outwardly project, the press work for forming the portion can be easily done by a simple press machine.

While the invention has been described in conjunction with preferred specific embodiments thereof, it will be understood that this description is intended to illustrate and not limit the scope of the invention, which is defined by the following claims.

What is claimed is:

1. A carriage supporting device for a printer having a platen, a frame with a base plate, a guide bar disposed in parallel with the axis of the platen and supported on the frame, a guide portion formed at a side portion of the base plate, the improvement comprising said guide portion being in the form of a plate and having an L-shaped section comprising an upright portion and a guide rail projecting horizontally outwardly and extending in parallel with said guide bar and having a flat upper surface and a flat underside surface;

a carriage slidably mounted on said guide bar and having a first connecting portion extending horizontally outwardly from said carriage to a position above and adjacent to said guide rail so as to be positioned in parallel with said guide rail;

a guide chip made of plastic and having a second connecting portion in the form of a hole and an engaging groove below said second connecting portion, said guide chip being removably secured to said carriage and slidably engaged with said guide rail by engaging said second connecting portion with said first connecting portion by friction, and at the same time by engaging said engaging groove with said guide rail, whereby a portion of said guide chip between said second connection portion and said engaging groove is interposed between said first connection portion and said guide rail, so that said carriage is slidably supported on said guide bar and said guide rail.

2. The carriage supporting device according to claim 1 wherein said base plate is made of metal plate and said guide portion is formed by bending a rear portion of said base plate.

* * * * *